US007984884B1

(12) United States Patent
Iliev

(10) Patent No.: US 7,984,884 B1
(45) Date of Patent: Jul. 26, 2011

(54) ARTIFICIAL CHRISTMAS TREE STAND

(75) Inventor: Vall A. Iliev, Stow, OH (US)

(73) Assignee: B.I.G. Ideas, LLC, Stow, OH (US)

( * ) Notice: Subject to any disclaimer, the term of this patent is extended or adjusted under 35 U.S.C. 154(b) by 87 days.

(21) Appl. No.: 12/506,389

(22) Filed: Jul. 21, 2009

Related U.S. Application Data

(60) Provisional application No. 61/087,396, filed on Aug. 8, 2008.

(51) Int. Cl.

| | |
|---|---|
| ***A47G 23/02*** | (2006.01) |
| ***F16M 13/00*** | (2006.01) |
| ***F16M 11/00*** | (2006.01) |
| ***F16M 11/32*** | (2006.01) |
| ***F16M 11/38*** | (2006.01) |
| ***F16M 11/24*** | (2006.01) |
| ***E04G 3/00*** | (2006.01) |

(52) U.S. Cl. ..... 248/146; 248/523; 248/524; 248/525; 248/526; 248/527; 248/528; 248/529; 248/150; 248/166; 248/167

(58) Field of Classification Search ..... 248/523–529, 248/519, 512, 146, 150, 163.1, 431, 165, 248/166, 168, 170, 169, 292.12, 292.14
See application file for complete search history.

(56) References Cited

U.S. PATENT DOCUMENTS

| | | | | |
|---|---|---|---|---|
| 2,410,227 | A * | 10/1946 | Carlton | 47/40.5 |
| 2,416,435 | A * | 2/1947 | Carlberg | 248/524 |
| 2,681,780 | A * | 6/1954 | Santoro | 47/40.5 |
| 3,058,707 | A * | 10/1962 | Lego | 248/524 |
| 4,007,901 | A * | 2/1977 | Mancini et al. | 248/526 |
| 4,261,138 | A * | 4/1981 | St. George Syms | 47/40.5 |
| 4,653,710 | A * | 3/1987 | Dickison | 248/188.7 |
| 5,465,529 | A * | 11/1995 | Park | 47/40.5 |
| 5,492,301 | A | 2/1996 | Hauser | |
| 5,593,743 | A | 1/1997 | Baker | |
| 5,673,893 | A * | 10/1997 | Klein | 248/525 |
| 6,094,859 | A | 8/2000 | Kalman et al. | |
| 6,142,441 | A * | 11/2000 | Vannucci | 248/519 |
| D454,518 | S | 3/2002 | Krinner et al. | |
| 6,681,519 | B2 | 1/2004 | Cone | |
| 2007/0012851 | A1* | 1/2007 | Krinner | 248/524 |
| 2007/0089648 | A1* | 4/2007 | Harrison et al. | 108/115 |
| 2008/0283692 | A1* | 11/2008 | Leinen | 248/125.8 |

* cited by examiner

*Primary Examiner* — Terrell McKinnon
*Assistant Examiner* — Christopher Garft
(74) *Attorney, Agent, or Firm* — John D. Gugliotta, PE, Esq.

(57) ABSTRACT

An artificial Christmas tree stand comprises a receptacle, at least three equally spaced legs radially extending therefrom, an equal plurality of braces pivotally extending upwards from the legs' lengths, and outer struts and corresponding inner struts that travel a track in the braces' lengths. The legs pivot downwards 90° to collapse the stand for storage. The brace is extendable about a height of the tree trunk so that its claws can engage the trunk at a manually manipulated height. The braces essentially support the trunk upright as opposed to the conventional receptacle.

11 Claims, 8 Drawing Sheets

ARTIFICIAL CHRISTMAS TREE STAND

RELATED APPLICATIONS

The present invention claims any benefit of is a continuation in part of U.S. Provisional Patent Application 61/087,396 filed on Aug. 8, 2008.

BACKGROUND OF THE INVENTION

1. Field of the Invention

The present invention relates to an artificial Christmas tree stand and, more particularly, to a collapsible stand that clamps to a trunk by means of brace members having a moveable outer-and-inner strut assembly.

2. Description of the Related Art

A Christmas tree is the most well-known winter-holiday symbol, and it is likely the most widely used indoor decoration. There is recently invented a plurality of artificial trees which make assembly less timely and less complicated. There is also a corresponding plurality of stands designed to support these trees. The present invention discloses an artificial Christmas tree stand which is less space consumptive, more supportive, and easier to manipulate. A search of the prior art reveals no teachings which read on the appended claims; however, the following references are considered pertinent:

U.S. Pat. No. 6,681,519 to Cone teaches a "self-clamping Christmas tree stand" which comprises clamping members that compressively drive against a tree trunk;

U.S. Pat. No. 6,142,441 to Vennucci teaches a "commercial location Christmas tree stand" having three legs, and portions of which comprise a threaded shaft that receives thumb screws that press on a tree trunk;

U.S. Pat. No. 6,094,859 to Kalman et al. teaches a "tree stand" having three arms attached to a receptacle, each arm circumferentially spaced around a sleeve, wherein the arms hingedly move inwardly towards a trunk so a distal sharp point can engage the latter;

U.S. Pat. No. 5,593,743 to Baker teaches a "Christmas tree skirt support" that comprises a plurality of special braces that angle inwards to a sleeve that circumscribes a tree trunk;

U.S. Design D454,518 to Krinner et al. shows a "Christmas tree stand" that comprises a plurality of legs that meet at a receptacle and an equal plurality of brace members that extend upwards therefrom towards a trunk; and, U.S. Pat. No. 5,492,301 to Hauser teaches a "Christmas tree stand" having base legs with longitudinal leg slots which receive corresponding wing-bolts of extension plates.

Most tree stands comprise bolts which travel through apertures to impinge against tree trunks. The present design rather includes braces which comprise both inner and outer struts that move against one another to cause a claw on the brace to snap-press against a portion of the tree trunk. These struts further travel along a track to make the artificial Christmas tree stand collapsible.

SUMMARY OF THE INVENTION

It is an object of the present invention to teach an artificial Christmas tree stand that supports a tree at its trunk.

It is an object that the present stand reduces a length of legs so that they are less obstructive both to the tree's appearance and to the space where gifts rest. It is an object to focus support of the Christmas tree at a height on the trunk by means of brace members.

It is a further object of the present invention to teach a stand which makes assembly less timely.

It is an object to make the tree stand collapsible so that it may easily unfold for assembly and fold for storage. It is envisioned that all components pivotally collapse so that they rest in one axis.

It is an additional object of the stand to make assembly less complicated.

It is envisioned that the present Christmas tree stand comprise a receptacle for which a distal end of a tree trunk rests. At least three equally spaced legs are pivotally affixed to the receptacle. Three braces extend upwards from a length of the legs towards the tree trunk. Combination outer struts and inner struts move about gears to adjust the braces about a circumference of the tree trunk It is a final object of the present invention to provide all of the further benefits of the foregoing objects.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures

I. Detailed Description of the Figures

Figure 1:
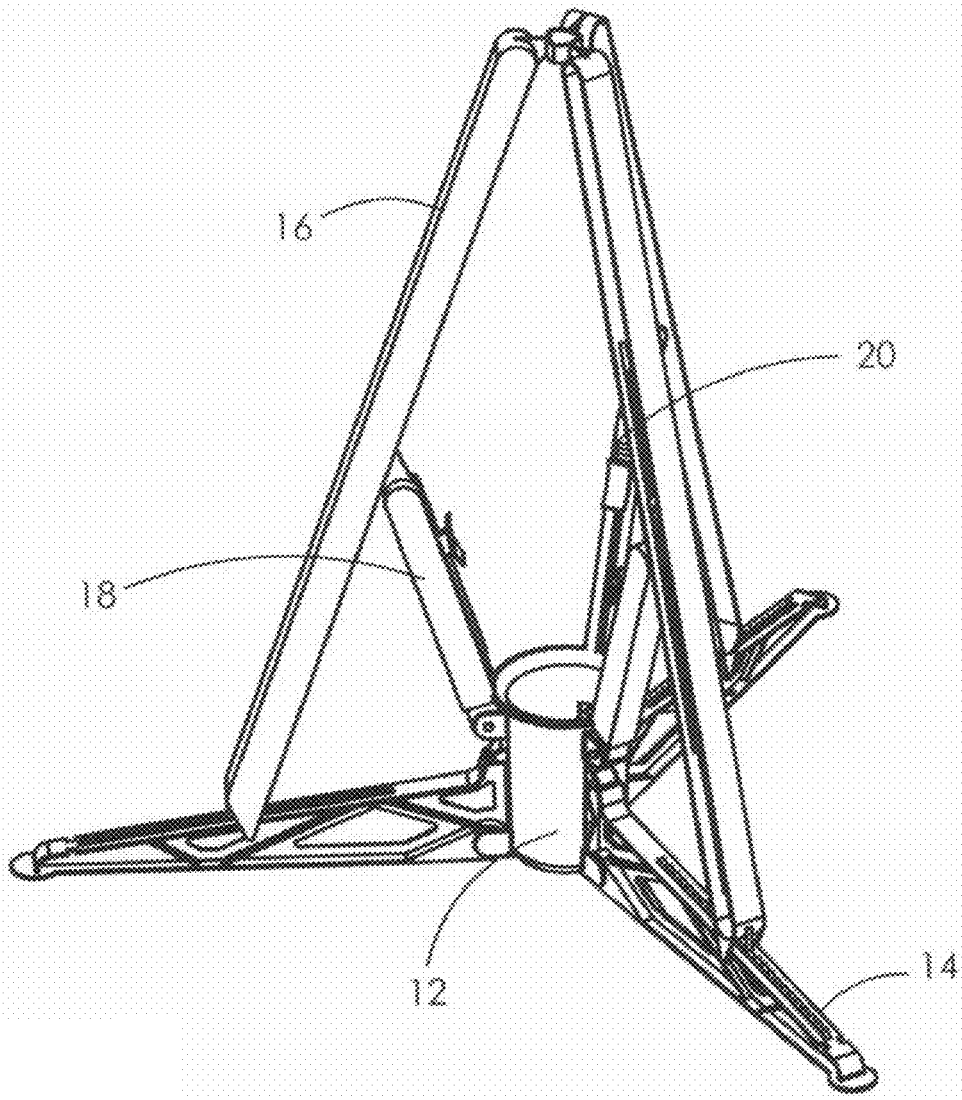
FIG. 1 is a top-front elevational view of an artificial Christmas tree stand according to the present invention.

A top elevational view of an artificial Christmas tree stand 10 (hereinafter "the stand") is shown in FIG. 1 according to a preferred embodiment of the present invention. The stand 10 namely comprises a receptacle 12, at least three equally spaced legs 14 radially extending therefrom, an equal plurality of braces 16 pivotally extending upwards from the legs' lengths, and outer struts 18 and corresponding inner struts 20 that travel a track in the braces' lengths.

The receptacle 12 receives the most distal end of an artificial tree trunk. It may comprise a height less than that of receptacles in most conventional stands because its continuous sidewall is not the primary means for supporting the tree; rather, the receptacle 12 offers stability whilst the braces 14 provide most the support at a height on the trunk.

Figure 2:
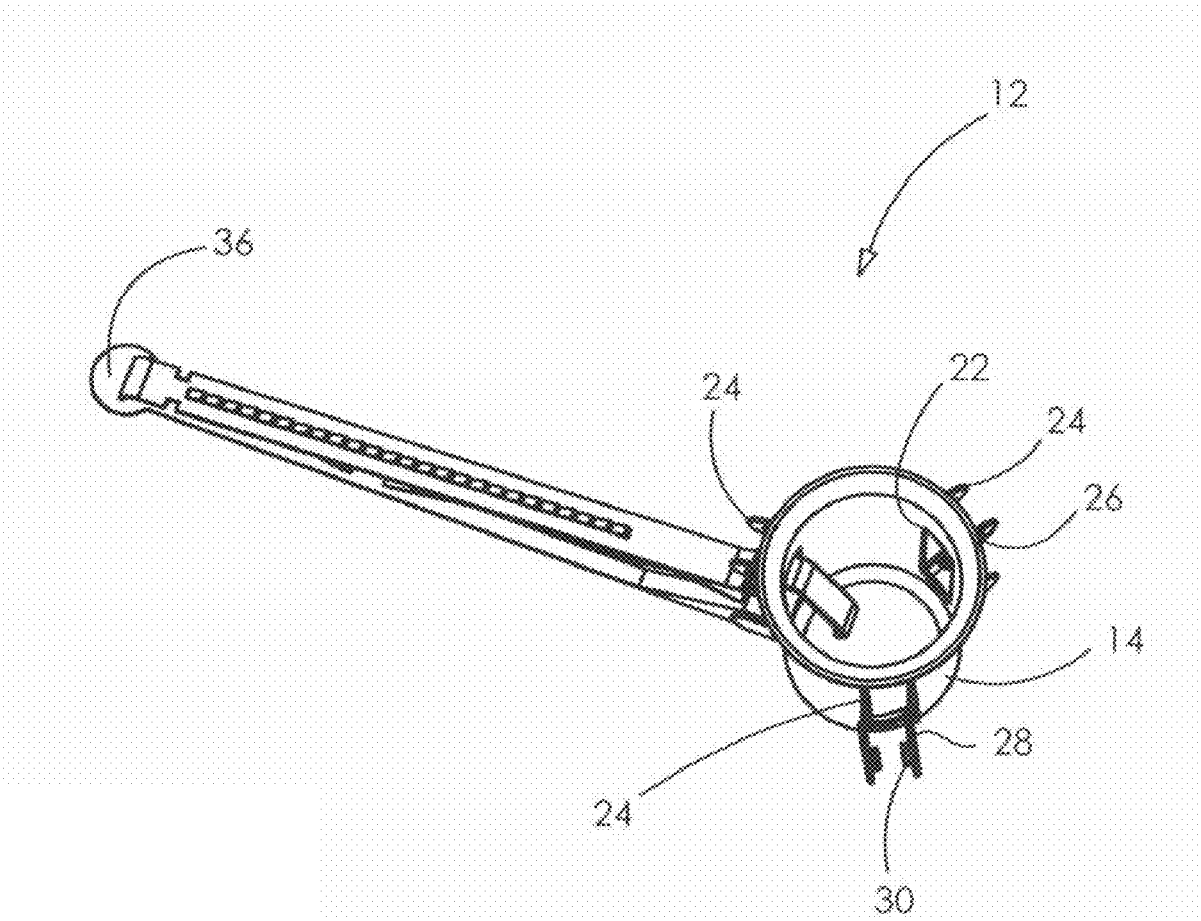
FIG. 2 is a top elevational view of a receptacle with one of the at least three legs attached thereto.

The receptacle 12 is better shown in FIG. 2, wherein at least three elongated windows 22 are formed in its continuous sidewall. The number of windows 22 is equal to the number of legs 14. A first pair of vertical axle tabs 24 protrudes outwards from opposing sides of the windows 22 at their uppermost corners. There are apertures 26 formed through the first tabs 24 to receive corresponding axle pins in the inner strut 20. A second pair of vertical axle tabs 28 protrudes outwards from opposing sides of the windows 22 at their lowermost corners. A protrusion 30 protrudes from the inside of each second tab 28. This protrusion 30 has a length capable of being received by a corresponding channel on the leg 14.

Figure 3:
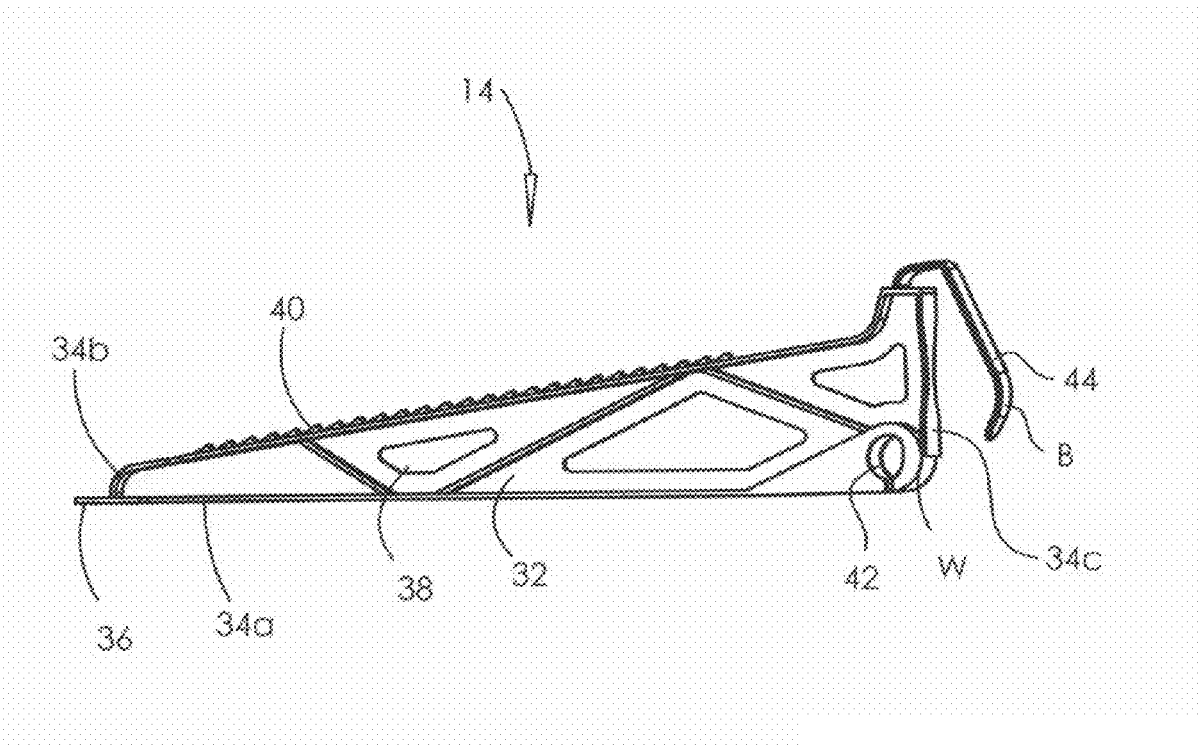
FIG. 3 is a side elevational view of the leg shown in FIG. 2.

A leg 14 is shown in greater detail in FIG. 3. The leg 14 is generally formed from an approximate right-triangle shaped wall 32 resting in a vertical plane. The wall 32 is circumscribed by edge-lengths 34*a*, 34*b*, 34*c* that are perpendicular to it. The bottom edge-length 34*a* rests in a horizontal plane; it abuts the floor surface where the erected Christmas tree is displayed. A circular foot 36 (See FIG. 2) is comprised at the very distal corner where the bottom edge 34*a* and the long edge 34*b* meet. This foot 36 plants to the floor to provide the entire stand 10 with greater stability. The foot 36 rests in the horizontal plane and it may simply continue from the bottom edge 34*a* so as to be part of the latter, except that it may comprise a greater width.

At least one window 38 is formed through the wall 32. This window 38 is shown in the figures to adopt a shape of the wall for which it rests, but it may comprise any shape that accommodates its intended function; hence, a slit may alternatively be comprised traveling the long edge 34*b* in the wall 32. The window 38 pivotally receives pins on a distal end of the brace 16. A series of teeth 40 climb the long edge 34*b*. A corresponding, but reverse shaped, point-tab on the brace 16 catches between two teeth 40 whilst the brace 16 is manipulated about a height of the trunk.

A channel 42 is formed through the inside-right corner of the leg 14. The wall 32 at the channel 42 thickens to match a width W of the edge-lengths 34. The channel 42 receives the opposing protrusions 30 on the inside of the second tabs 28 of the receptacle 12. The protrusions 30 act as axle pins so that the leg 14 is capable of pivoting about the receptacle 12.

A spring 44 extends from a top of the leg 14. The spring 44 protrudes outwards from the leg 14 until it travels through the near top portion of a window 22 in the receptacle 12. The spring 44 continues its horizontal travel to provide a little clearance from the sidewall before it angles downwards and inwards the receptacle 12. A slight bend B is formed through the spring 44 towards its distal end. The spring 14 is a self-centering mechanism (refer to FIG. 2) that guides a tree trunk to center in the receptacle 12.

An advantage to the present stand's 10 construction is that it is completely collapsible. The legs 14 fold downwards 90° when the stand 10 is prepared for storage. The legs 14 fold at the pivot formed between the second receptacle tabs 28 and the channel 42. The lengths of the springs 44 travel through the receptacle windows 22 whilst the legs 14 are collapsed.

Figure 4:
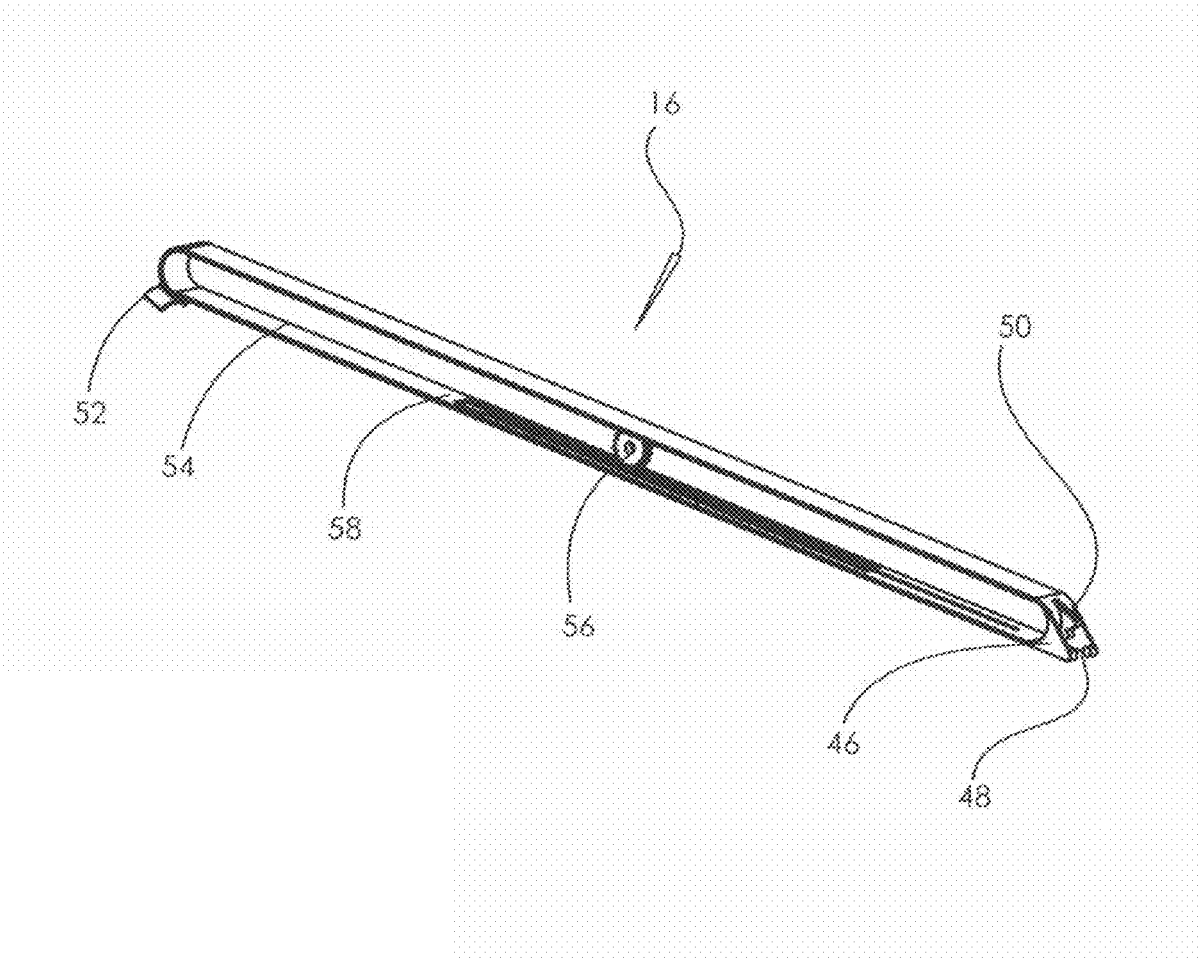
FIG. 4 is an elevational rear side view of a brace.

An elevational rear-side view of the brace 16 is shown in FIG. 4. The brace 16 is essentially an elongated member having a hollow interior closed on all but one long side. The brace 16 comprises a pair of brace tabs 46 which continue to extend from its bottom corners. Each of the opposing brace tabs 46 comprise a protrusion 48 extending from its inside surface (similar to that of tabs 28). The protrusions 48 act as axle pins (hereinafter synonymously referred to as both). The brace tabs 46 travel around the long edge 346 of the leg 14 so that the axle pin 48 is received in the wall window 38. The brace 16 is capable of moving about the wall window 38 when it is manually manipulated. Each time it is moved about, a triangular point-tab 50 catches between two of the teeth 40 to prevent the brace's 16 inadvertent movement.

A rigid claw 52 concavely extends outwards, and inwards, from the brace's inside distal end to engage the tree trunk. The claw 52 is concave shaped to approximate a circumference of the trunk. It snaps around the trunk to secure it firmly in place.

The hollow interior 54 of the brace 16 comprises at least one rigid track 56 for which pair of gears 56 move about. The linkages, or cogs, on the gear mesh with corresponding gear teeth on the track 56. The gears 56 sandwich a distal end of the outer strut 18. A brace slit 58 travels a majority length of the brace 16. The brace slit 58 receives that distal end of the outer strut 18.

Figure 5:
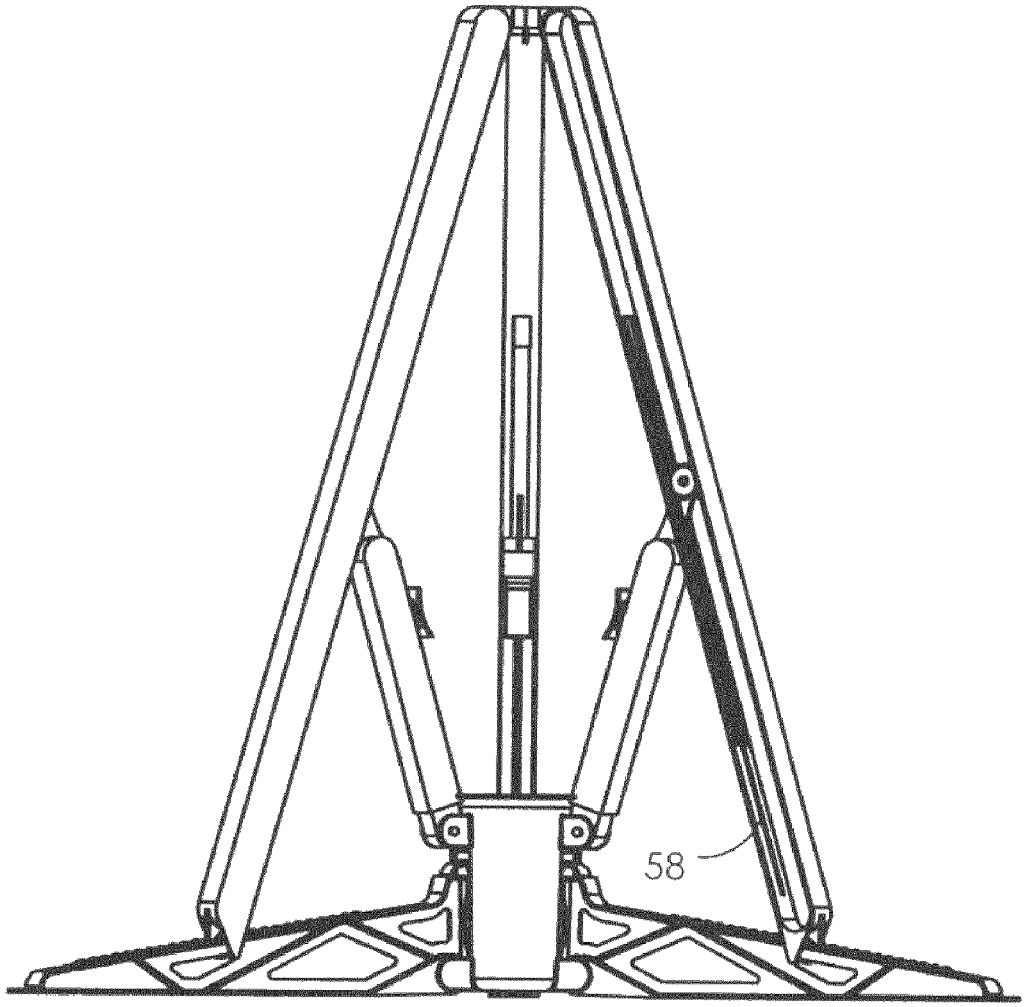
FIG. 5 is a side view of the stand.

A side view of the stand 10 is shown in FIG. 5, where the brace 16 is depicted with the outer strut's 18 distal end moveably received along its hollow interior 54. As can be viewable in the figure, the brace 16 is open along one length and yet not the other. The invention is not limited to this configuration; rather, the hollow interior 54 may be entire enclosed or the brace may be open along both lengths.

Figure 6:
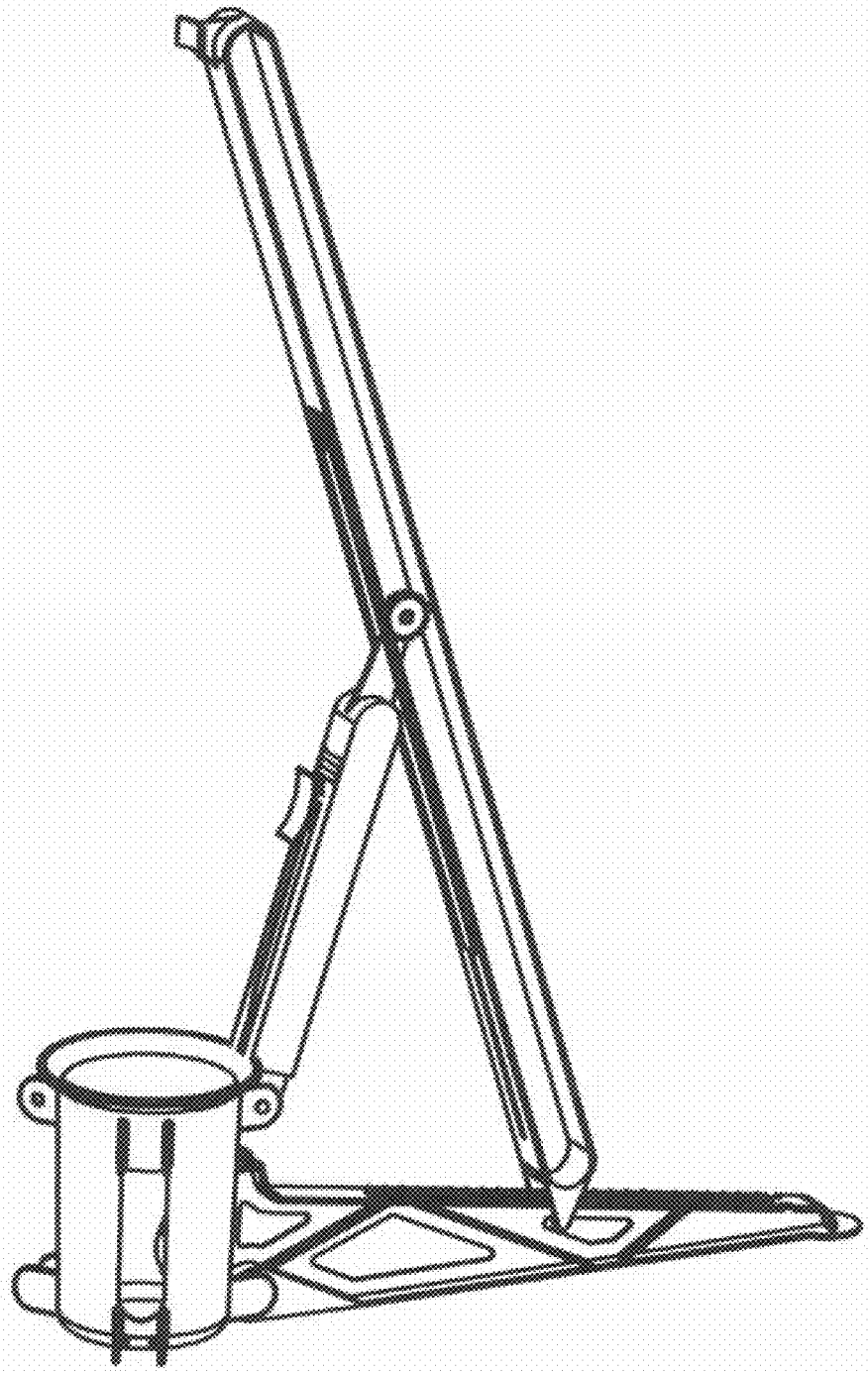
FIG. 6 shows a working relationship between the receptacle and one of the at least three legs, strut assemblies, and braces.
Figure 7A:
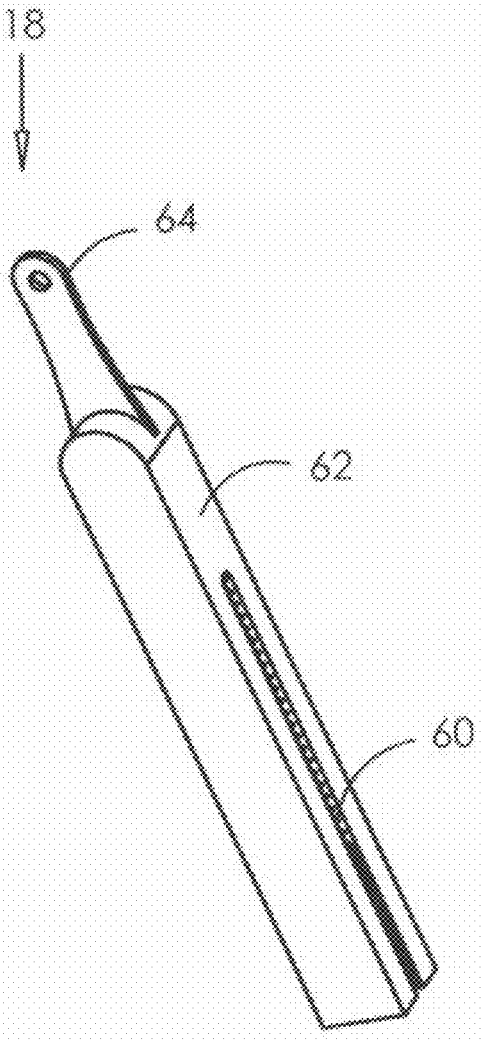
FIG. 7*a* is an inward facing side elevational view of the outer strut.
Figure 7B:
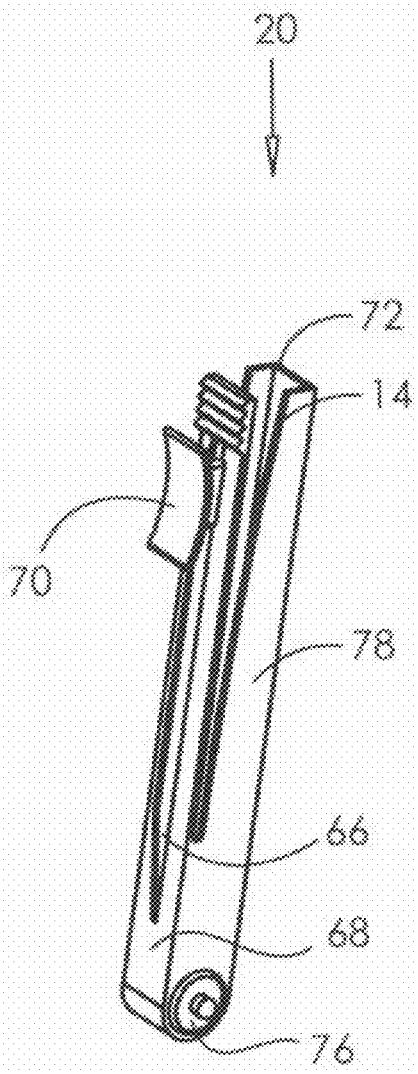
FIG. 7*b* is an inward facing side elevational view of the inner strut; and, FIG. 7*c* is an inward facing side elevational view of the outer-and-inner strut assembly.
Figure 7C:
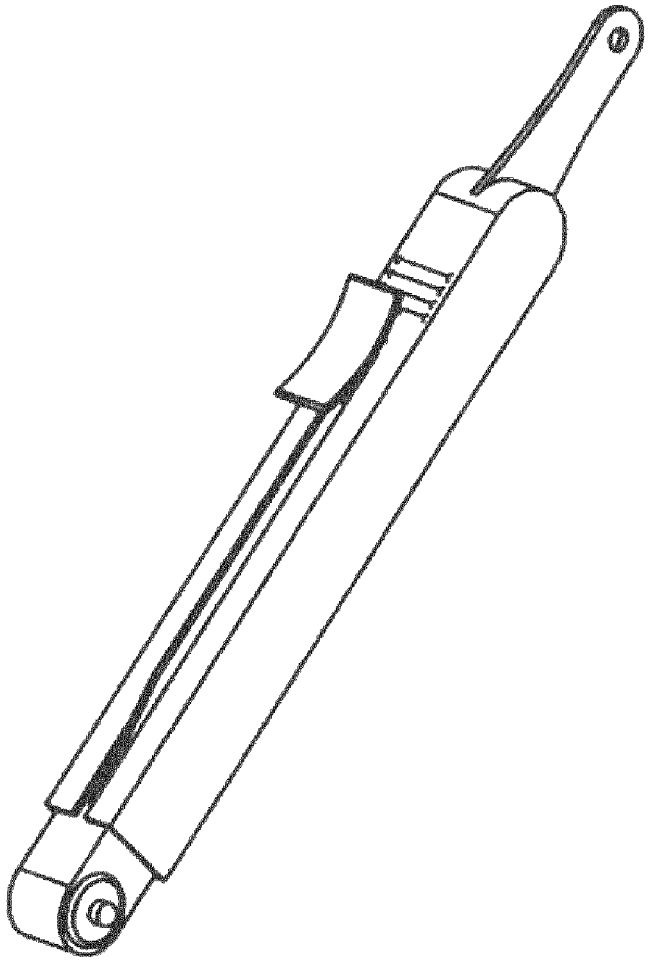

A working relationship between both struts 18, 20, the brace 16 and the leg 14 is shown in FIG. 6, and a discussion of that relationship will be returned to after both struts are described in greater detail according to FIGS. 7*a*-7*c*. The outer strut 18 is first shown in FIG. 7*a* to comprise a rectangular, elongate member, having a strut slit 60 formed along its innermost facing sidewall 62. The strut slit 60 is centered along the innermost sidewall 62; it travels a length of the sidewall from the latter's very bottom edge. A strut tab 64 extends from a top side of the outer strut 18 along the same axis as the strut slit 60. The strut tab 64 extends through the brace slit 58, where it is sandwiched by the pair of gears 56. An aperture through the strut tab 64 matches channels through the gears so that a pin or a similar connection means can travel therethrough to maintain their constant alignment.

The inner strut 20 is shown in FIG. 7*b*. The inner strut 20 is correspondingly rectangular in shape. A cross-section of the inner strut 20 is slightly smaller than that of the outer strut 18 because the former is essentially received in the latter (as shown in FIG. 7*c*). The outer strut 20 slips over the inner strut 18. The inner strut 18 comprises a rail 66 that corresponds to the strut slit 60. The rail 66 is centered along the innermost facing sidewall 68; it travels a length of the sidewall from the latter's very top edge. The strut slit 60 encloses the rail 66; they both travel about the other.

A knob 70 in the form of a protruding finger depression extends from a top of the rail 66 near an approximate distal end of the innermost sidewall 68. The knob 70 receives a finger; the latter presses against the former to push the innermost sidewall 68 towards the outermost sidewall 72. The innermost sidewall 68 is flexible; it can compress towards the outermost sidewall 72 to move the inner strut 20 about the outer strut 18. To achieve the ability to compress, portions of the remaining sidewalls 78 are cut-away at the top side so that a triangular-shaped cut-out 74 is formed. The long-edge of the triangular cut-out 74 starts closest to the outermost sidewall 72 and travels inwards. In this manner, the top of the innermost sidewall 68 compresses the most so that it is closest to the outermost sidewall 72 when the former is pressed against the latter. Finally, a pair of axle pin protrusions 76 protrude outwards from the bottom of the remaining sidewalls 78. These axle pin protrusions 76 are received in the first tab (24) apertures 26 on the receptacle wall. The outer an inner strut assembly 20, 18 is hence capable of pivoting about the receptacle 12.

2. Operation of the Preferred Embodiment

An operation of the preferred embodiment is best shown in FIG. 6, wherein a partial view of the stand is depicted with only one of the at least three leg-brace-and-strut assemblies. To utilize the stand, the legs are manually adjusted, at their pivots, to have their bottom edges rest flat against the floor surface. In this manner, it is anticipated that a bottom wall of the receptacle lies flush against that floor. The trunk portion of an artificial Christmas tree inserts into the receptacle; the trunk is automatically centered by means of the springs. The outside circumference of the trunk presses against the springs such that a tighter fit is achieved.

The brace pivots, so it is capable of expanding to accommodate larger trunks. Essentially, the strut assembly rolls about the brace slit as the brace pivots at the leg. The claw on the brace snaps to engage the tree trunk. As the strut assembly rolls about the brace slit, it pivots at the receptacle first tabs to accommodate any change in its angle relative to the brace.

If the user believes better support is achieved if the braces are lifted or lowered in relation to the tree trunk, they can be manually adjusted so that they snap engage the trunk at the trunk's varied heights. To change the height at which the brace engages the trunk, the user presses the knob at the strut assembly so that he or she can manipulate the brace relative to the leg. The brace can be moved along the long edge of the leg such that its point-tab catches between different teeth. The pin axles on the brace move about the window in the leg's wall.

To prepare the present stand for storage, the leg pivots 90° downward so that it rests parallel to the same longitudinal axis of the receptacle. The strut assembly is slid to the distal end of the brace slit, and the brace tab is moved to catch between the innermost distal teeth. In this manner, the entire stand collapses to essentially rest in one axis.

The foregoing descriptions of specific embodiments of the present invention are presented for purposes of illustration and description only. They are not intended to be exhaustive or to limit the invention to the precise forms disclosed and, obviously, many modifications and variations are possible in light of the above teaching. The embodiments are chosen and described in order to best explain the principles of the invention and its practical application, to thereby enable others skilled in the art to best utilize the invention and the embodiments with various modifications as are suited to the particular use contemplated. It is intended that a scope of the invention be defined by the Claims appended hereto and to their equivalents. Therefore, the scope of the invention is to be limited only by the following claims.

Having thus described the invention what is claimed as new and desired to be secured by Letters Patent is as follows:

1. An artificial Christmas tree stand comprises:
- a receptacle, wherein the receptacle comprises:
  - a plurality of elongated windows equal to a number of the legs;
  - a first pair of vertical axle tabs protruding outwards from opposing sides of the windows at their uppermost corners;
  - apertures formed through the first tabs to receive corresponding axle pins in inner struts;
  - a second pair of vertical axle tabs protruding outwards from opposing sides of the windows at their lowermost corners; and,
  - a protrusion protruding from the inside of each second tab;
- at least three equally spaced legs radially extending therefrom;
- an equal plurality of braces pivotally extending upwards from the legs' lengths; and,
- outer struts and corresponding to the inner struts that travel a track in the braces' lengths.

2. The stand of claim 1, wherein the leg comprises:
- an approximate right-triangle shaped wall resting in a vertical plane;
- a long edge, a bottom edge and a side edge length perpendicular to and circumscribing the wall;
- a horizontal circular foot comprised at the very distal corner where the bottom edge and the long edge meet;
- at least one window formed through the wall such that it has a length that travels a portion of the long edge;
- a series of teeth climb the long edge; and,
- a channel formed through the inside-right corner of the leg.

3. The stand of claim 2, the wall at the channel thickens to match a width of the edge-lengths.

4. The stand of claim 2, further comprising a spring that extends from a top of the leg, wherein the spring protrudes outwards from the leg until it travels through the near top portion of a window in the receptacle, the spring continues its horizontal travel to provide a little clearance from a sidewall of the receptacle before it angles downwards and inwards the receptacle.

5. The stand of claim 4, wherein the legs fold downwards 90° to collapse the stand for storage, the legs fold at the pivot formed between tabs on the lower wall of the receptacle and the channel.

6. An artificial Christmas tree stand comprises:
- a receptacle,
- at least three equally spaced legs radially extending therefrom;
- an equal plurality of braces pivotally extending upwards from the legs' lengths; and,
- outer struts and corresponding inner struts that travel a track in the braces' lengths; wherein the brace comprises:
- an elongated member having a hollow interior closed on at least all but one long side;
- a pair of brace tabs which continue to extend from its bottom corners;
- a protrusion extending from an inside surface of each of the opposing brace tabs, the brace tabs travel around a long edge of the leg so that the protrusion is received in a wall window on the leg;
- a triangular point-tab to catch between two teeth on the leg to prevent the brace's inadvertent movement; and,
- a rigid claw concavely extending outwards, and inwards, from the brace's inside distal end to engage the tree trunk.

7. The stand of claim 6, wherein the brace further comprises:
- at least one rigid track in the hollow interior for which a pair of gears move about, linkages on the gear mesh with corresponding gear teeth on the track, wherein the gears sandwich a distal end of the outer strut; and,
- a brace slit that travels a majority length of the brace, the brace slit receives that distal end of the outer strut.

8. The stand of claim 1, wherein the outer strut comprises:
- a rectangular, elongate member, having a strut slit formed along its innermost facing sidewall, the strut slit is centered along the innermost sidewall and it travels a length of that innermost sidewall from the outer strut's very bottom edge; and,
- a strut tab extending from a top side of the outer strut along the same axis as the strut slit, the strut tab extends through the brace slit, where it is sandwiched by the pair of gears housed in an interior of the brace.

9. The stand of claim 1, wherein the inner strut comprises:
- a rectangular, elongate member having a cross-section slightly smaller than that of the outer strut;

a rail that corresponds to a slit on the outer strut, the rail is centered along a flexible, innermost facing sidewall and it travels a length of the innermost facing sidewall from the inner strut's very top edge;

a knob in the form of a protruding finger depression extending from a top of the rail near an approximate distal end of the innermost sidewall;

a triangular-shaped cut-out cut away from a portion of opposing side walls of the inner strut, a long-edge of the triangular cut-out starts closest to an outermost sidewall and travels inwards; and, a pair of axle pin protrusions protruding outwards from a bottom of the opposing sidewalk, the axle pin protrusions are received in tab apertures on the receptacle wall; wherein the knob is pressed to push the innermost sidewall towards the outermost sidewall to move the inner strut about the outer strut.

10. The stand of any of claim 8, wherein the outer strut slips over the inner strut to receive it, the strut slit encloses the rail such that they both travel about the other.

11. The stand of any of claim 9, wherein the outer strut slips over the inner strut to receive it, the strut slit encloses the rail such that they both travel about the other.

* * * * *